United States Patent [19]

Kohus

[11] Patent Number: 4,779,315

[45] Date of Patent: Oct. 25, 1988

[54] BUCKLE WITH RELEASABLY INTERLOCKABLE MEMBERS

[75] Inventor: Louis M. Kohus, Cincinnati, Ohio

[73] Assignee: Illinois Tool Works Inc., Glenview, Ill.

[21] Appl. No.: 88,581

[22] Filed: Aug. 24, 1987

[51] Int. Cl.[4] ..... A44B 11/25

[52] U.S. Cl. ..... 24/575; 24/625

[58] Field of Search ..... 24/575, 576, 587, 615, 24/614, 625, 313, 200

[56] References Cited

U.S. PATENT DOCUMENTS

| | | | |
|---|---|---|---|
| 4,150,464 | 4/1979 | Tracy | 24/313 |
| 4,171,555 | 10/1979 | Bakker et al. | 24/200 |
| 4,569,106 | 2/1986 | Lovato | 24/575 |
| 4,577,377 | 3/1986 | Kasai | 24/625 |
| 4,621,393 | 11/1986 | Ambal | 24/576 |
| 4,660,259 | 4/1987 | Ausnit | 24/576 |
| 4,672,725 | 6/1987 | Kasai | 24/625 |

*Primary Examiner*—Victor N. Sakran

*Attorney, Agent, or Firm*—Dressler, Goldsmith, Shore, Sutker & Milnamow, Ltd.

[57] ABSTRACT

A buckle of a type comprised of two identical members, which can be releasably interlocked to each other. Each member has first and second cantilevered arms, one of which is resiliently flexible and has a locking tab, and which are adapted to wedge against an internal wedge formed in the outer member so as to cause the members to spring apart when released. The locking tabs can be manually pressed by a user to release the members.

5 Claims, 3 Drawing Sheets

BUCKLE WITH RELEASABLY INTERLOCKABLE MEMBERS

BACKGROUND OF THE INVENTION

This invention pertains generally to a buckle of a type comprising two releasably interlockable members, for use with a belt of webbing or other material, and particularly to such a buckle comprising two identical, releasably interlockable members.

As exemplified in U.S. Pat. Nos. 4,171,555 (see FIG. 10) and in 4,150,464, it is known to provide a buckle of the type noted above, in which a pair of locking tabs fit into a pair of locking slots, so as to lock two members releasably to each other, and in which a user is able manually to press on the locking tabs, so as to remove the locking tabs from the locking slots, thereby to release the members from each other.

As exemplified in U.S. Pat. No. 4,569,106, it is known in a buckle of the type noted above for two identical, releasably interlockable members to be similarly releasable by a user pressing on a pair of locking tabs, so as to release the locking tabs from a pair of locking slots, which are offset in relation to each other.

Although the buckle disclosed in U.S. Pat. No. 4,569,106 offers significant advantages, particularly in terms of manufacturing, the releasable interlockable members of the buckle disclosed therein do not reliably spring apart when the locking tabs are released from the locking slots so as to release such members from each other.

There has been a need, to which this invention is addressed, for an improvement in such a buckle.

SUMMARY OF THE INVENTION

It is a principal object of this invention to provide an improved buckle of the type noted above. This invention may be advantageously embodied in such a buckle comprising two identical members, which are releasably interlockable to each other.

In accordance with a preferred embodiment of this invention, each member includes a receptacle and has a camming surface. The camming surface of such members may be ramps inclined in relation to each other. Each member has a locking aperture communicating with the receptacle of such member.

Furthermore, each member includes a cantilevered arm, which is adapted to be manually pressed into the receptacle of the other member when the members are juxtaposed and pressed together. The cantilevered arm of each member is resiliently flexible, has an unflexed position, and tends to return to the same position when not flexed. The cantilevered arm of each member is provided with a locking tab, which is adapted to be removably received by the locking aperture of the other member, so as to releasably lock the first and second members to each other, when the arms of each member are pressed fully into the receptacle of the other member. The camming surface of each member is adapted to wedge against the other member, so as to draw the members from respective positions wherein the members are not aligned with each other into respective positions wherein the members are aligned with each other, as the arms of each member are pressed partially into the receptacle of the other member.

Moreover, the locking apertures are arranged to permit a user to press on the locking tabs so as to remove the locking tabs from the locking apertures, and so as to displace the first and second members in relation to each other, generally along the camming surfaces of the respective members, such that the first and second members tend to be forced apart and to spring apart under pressure on the locking tabs.

Because the first and second members are identical to each other, significant advantages are offered, particularly in terms of manufacturing. Thus, the first and second members can be injection molded by means of a single mold, from a suitable polymer, such as an acetal resin, which is a hard, tough, and resilient engineering resin, and which is preferred.

These and other objects, features, and advantages of this invention will be better understood from the following descriptions of a preferred embodiment of this invention and an alternative embodiment of this invention, with reference to the accompanying drawings.

DETAILED DESCRIPTION OF ILLUSTRATED EMBODIMENTS

Figure 1:
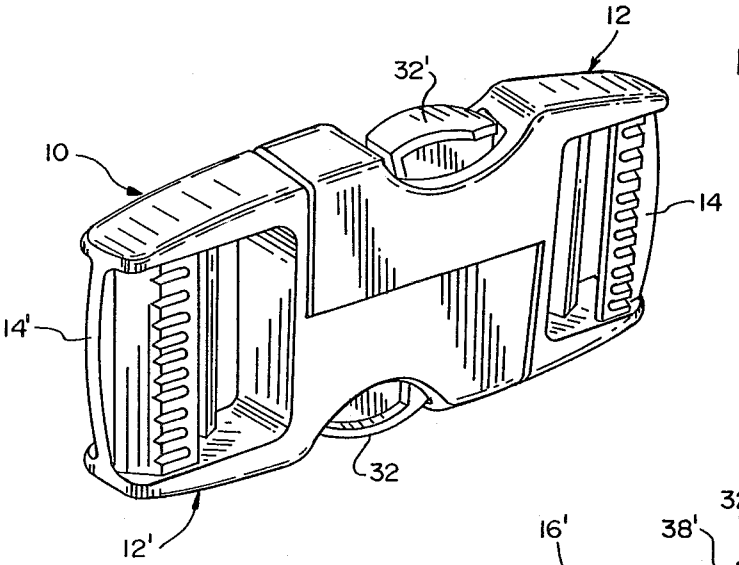
FIG. 1 is a perspective view of a buckle constituting a preferred embodiment of this invention.

As shown in the drawings, a buckle 10, which is designed for use with a belt (not shown) of webbing or other material, comprises a first member 12 and a second member 12', which are identical to each other, and which are inverted in relation to each other when juxtaposed, presented to each other, and pressed together, as described below, so as to interlock the first member 12 and the second member 12' releasably to each other.

The first member 12 and the second member 12' may be injection molded by means of a single mold (not shown) from a suitable polymer, such as an acetal resin, which is preferred, as mentioned above.

The first member 12 has a belt-attaching end 14 including a slot 16, through which a first end of the belt may be passed before being riveted or stitched to other portions of the belt so as to form a closed loop in the belt. The second member 12' has a belt-attaching end 14' including a slot 16', through which a second end of the belt may be passed before being riveted or stitched to other portions of the belt so as to form a closed loop in the belt.

The first member 12 includes a receptacle 18, which has an outer wall 20, and a locking aperture 22, which is provided in the outer wall 20, and which communicates with the receptacle 18. The first member 12 has a first ramp 24, which may or may not be inclined, as shown, in relation to longitudinal axes of the buckle 10, and which is formed on an inner surface of the outer wall 20, and a second ramp 26, which is formed on a shelf portion to be hereinafter described. The first ramp 24 and the second ramp 26 are inclined in relation to each other, as shown, so as to form an internal wedge. The second member 12′ includes a receptable 18′, which is identical to the receptacle 18 of the first member 12 with a locking slot 22′ being provided in an outer wall 20′ of the receptacle 18′ and communicating with the receptacle 18′. The second member 12′ has a first ramp 24′, which is identical to the first ramp 24 of the first member 12, and a second ramp 26′, which is identical to the second ramp 26 of the first member 12. Thus, in the second member 12′, the first ramp 24′ and the second ramp 26′ also form an internal wedge.

The first member 12 includes a cantilevered arm 28, which is provided on its distal end with a locking tab 30 having a convex wedging surface 32, and a shelf portion 34, on which the second ramp 26 is formed. The second member 12′ includes a cantilevered arm 28′ which is provided on its distal end with a locking tab 30′ having a convex wedging surface 32′ and a shelf portion 34′, on which the second ramp 26′ is formed.

Figure 3:
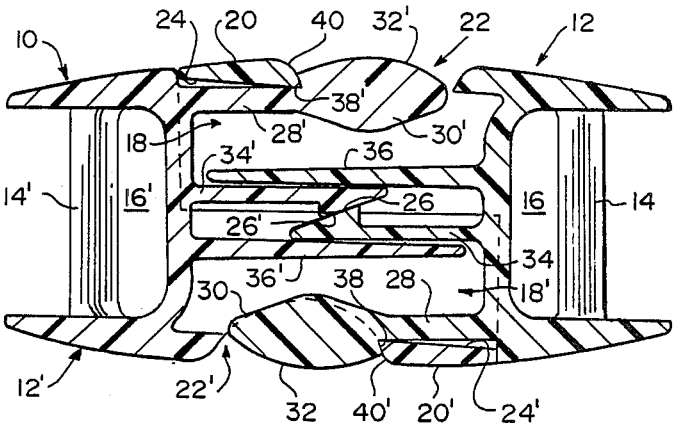
FIGS. 3, 4, and 5 are longitudinal sectional views of the buckle of FIGS. 1 and 2, the buckle being shown in a fully locked condition in FIG. 3, in an intermediate condition in FIG. 4, and in a fully unlocked condition in FIG. 5.
Figure 4:
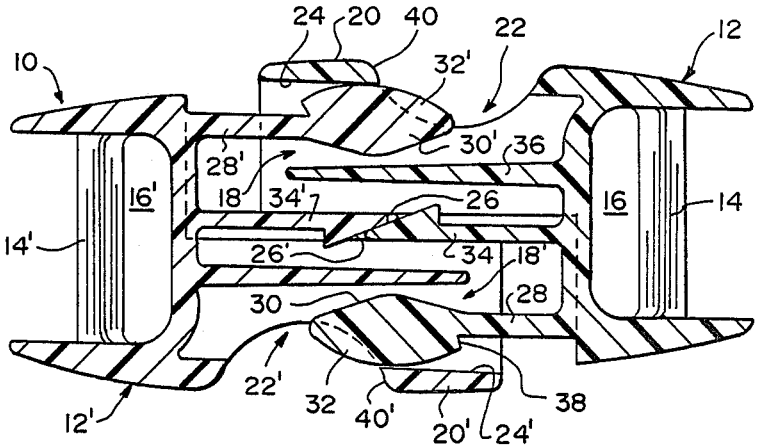

The cantilevered arm 28 and the shelf portion 34 are adapted to be pressed into the receptacle 18′ of the second member 12′ when the first member 12 and the second member 12′ are juxtaposed, presented to each other, and pressed together. The cantilevered arm 28, which is resiliently flexible, has an unflexed position (see FIG. 3) in relation to the shelf portion 34 and tends to return to the same position when not flexed. The convex wedging surface 32 of the locking tab 30 is structurally and dimensionally adapted to wedge against the first ramp 24′ of the second member 12′ when the first cantilevered arm 28 and the shelf portion 34 are pressed partially into the receptacle 18′ of the second member 12′ (see FIG. 4) and to be removably received by the locking aperture 22′ of the second member 12′ when the first cantilevered arm 28 and the shelf portion 34 are pressed fully into the receptacle 18′ of the second member 12′ (see FIG. 3). The second ramp 26 of the shelf portion 34 of the first member 12 is structurally and dimensionally adapted to wedge against the second ramp 26′ on the shelf portion 34′ of the second member 12′ when the cantilevered arm 28 and the shelf portion 34 are pressed partially or fully into the receptacle 18′ of the second member 12′ (see FIGS. 3 and 4).

The first cantilevered arm 28′ and the shelf portion 34′ are adapted to be pressed into the receptacle 18 of the first member 12′ when the first member 12 and the second member 12′ are juxtaposed, presented to each other, and pressed together. The cantilevered arm 28′, which is resiliently flexible, has an unflexed position (see FIG. 3) in relation to the second cantilevered arm 34′ and tends to return to the same position when not flexed. The convex wedging surface 32′ of the locking tab 30′ is structurally and dimensionally adapted to wedge against the first ramp 24 of the first member 12 when the cantilevered arm 28′ and the shelf portion 34′ are pressed partially into the receptacle 18 of the first member 12 (see FIG. 4) and to be removably received by the locking aperture 22 of the first member 12 when the cantilevered arm 28′ and the shelf portion 34′ are pressed fully into the receptacle 18 of the first member 12′ (see FIG. 3). The second ramp 26′ of the cantilevered arm 34′ of the second member 12′ is structurally and dimensionally adapted to wedge against the second ramp 26 on the shelf portion 34 of the first member 12, when the cantilevered arm 28′ and the second shelf portion 34′ are pressed partially or fully into the receptacle 18 of the first member 12 (see FIGS. 3 and 4).

As the ramps 26, 26′, wedge against each other, the members 12, 12′, are drawn from respective positions (see FIG. 4) wherein the members 12, 12′, are not aligned with each other into respective positions (see FIG. 3) wherein the members 12, 12′, are aligned with each other.

Figure 2:
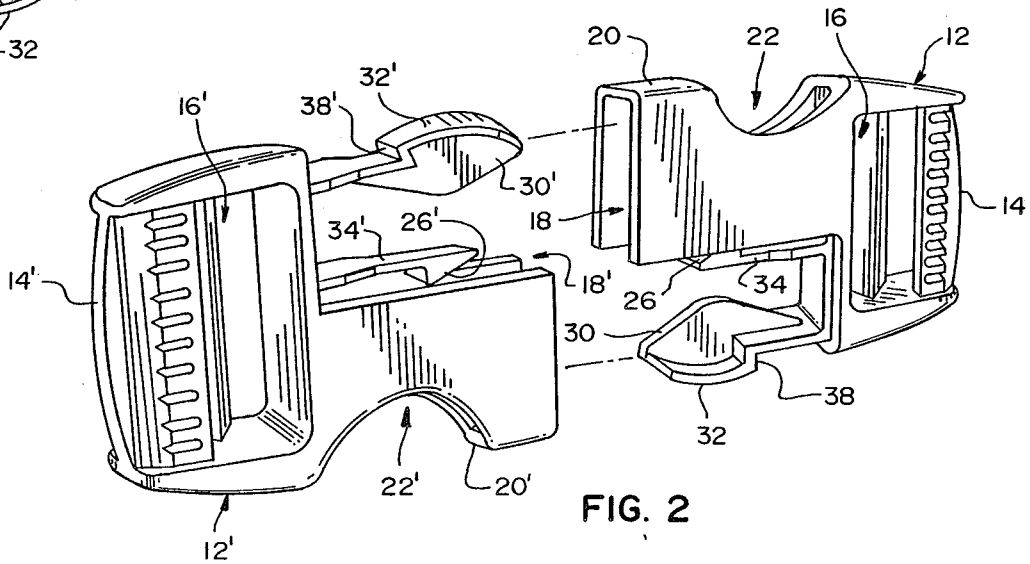
FIG. 2 is an exploded perspective view of identical first and second members of the buckle of FIG. 1.
Figure 5:
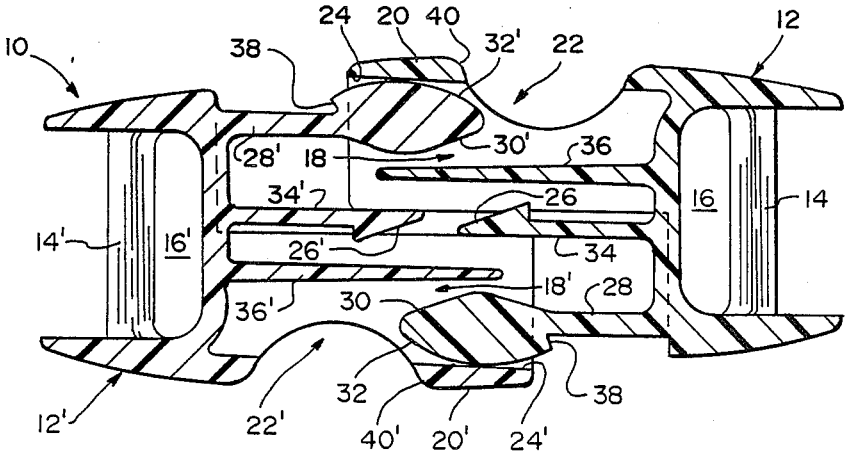
Figure 7:
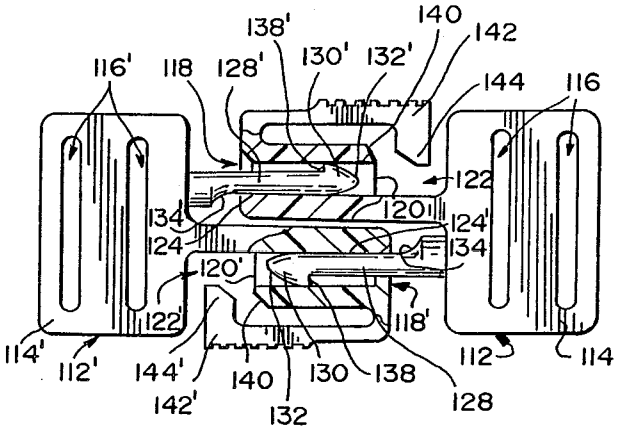
FIGS. 7, 8, and 9 are longitudinal, partially sectional views of the buckle of FIG. 6, the buckle being shown in a partially locked condition in FIG. 7, in an intermediate locked condition in FIG. 8, and in a fully locked condition in FIG. 9.
Figure 6:
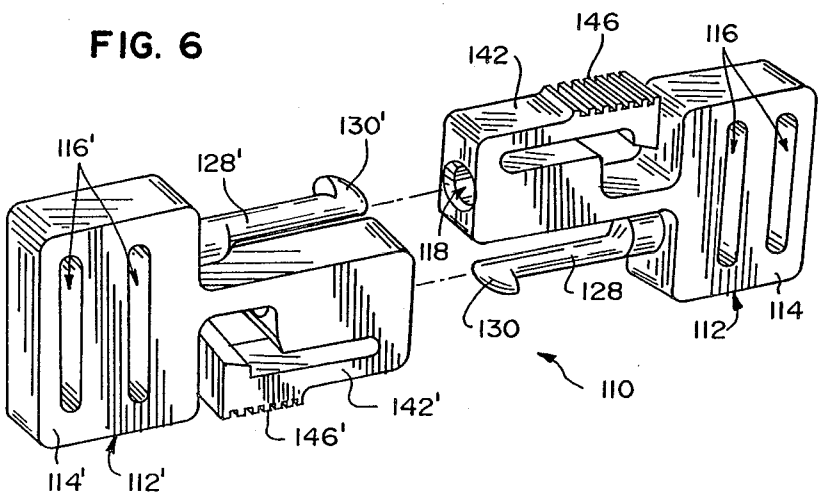
FIG. 6 is an exploded, perspective view of identical first and second members of a buckle constituting an alternative embodiment of this invention.
Figure 9:
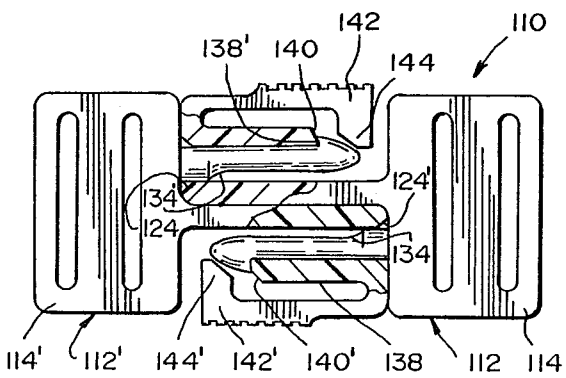
Figure 8:
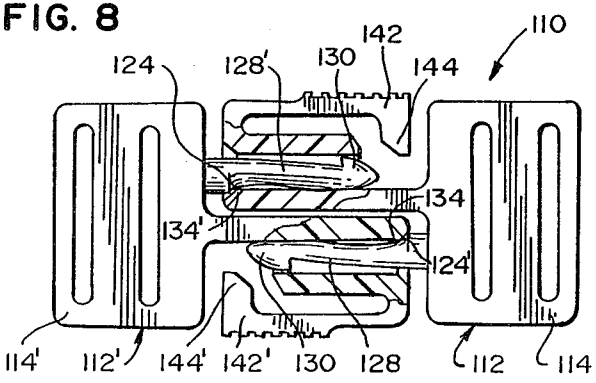

As presented to each other (see FIGS. 2 and 5) the members 12 and 12′ are vertically offset in relation to each other. When fully engaged (see FIG. 3) the members 12 and 12′ are in alignment with each other.

The first member 12 has a transverse shelf 36 between the first ramp 24 and the second ramp 26. The transverse shelf 36 forms one wall of the receptacle 18. The second member 12′ has a transverse shelf 36′ between the first ramp 24′ and the second ramp 26′. The transverse shelf 36′ forms one wall of the receptacle 18′. The transverse shelf 36 of the first member 12 is engaged by the shelf portion 34′ of the second member 12′ and the transverse shelf 36′ of the second member 12′ is engaged by the shelf portion 34 of the first member 12 (see FIG. 3) with a wedging action, which helps to lock the first member 12 and the second member 12′ to each other, when the locking tabs 30 is received by the locking aperture 22′ and the locking tab 30′ is received by the locking aperture 22.

When the locking tab 30 is received by the locking aperture 22′, a hooked edge 38 of the locking tab 30 is hooked over a complementarily shaped edge 40′ of the locking aperture 22′. When the locking tab 30′ is received by the locking aperture 22, a hooked edge 38′ of the locking tab 30′ is hooked over a complementarily shaped edge 40 of the locking aperture 22.

Each of the locking apertures 22, 22′, is dimensionally arranged to permit a user to press on the locking tabs 30, 30′, as by means of a thumb and a forefinger of one hand, so as to remove the locking tabs 30, 30′, from the locking apertures 22, 22′. The locking apertures 22, 22′, are horizontally offset in relation to each other, such that pressure on the similarly offset locking tabs 30, 30′, tends also to displace the first member 12 and the second member 12′ in relation to each other from their respective positions in FIG. 3 to their respective positions in FIG. 5, generally along the ramps 26, 26′, such that the first member 12 and the second member 12′ tend to spring apart under such pressure.

As shown, the shelf portions 34, 34′, tend to be relatively inflexible, as compared to the cantilevered arms 28, 28′. In an alternative embodiment (not shown) the shelf portions arms may be so shaped and so dimensioned as to be more flexible.

As shown in FIGS. 6 through 9, a buckle 110, which also is designed for use with a belt (not shown) of webbing or other material, comprises a first member 112 and a second member 112′, which are identical to each other, and which are inverted in relation to each other when juxtaposed, presented to each other, and pressed together, as described below, so as to interlock the first member 112 and the second member 112′ releasably to each other.

The first member 112 and the second member 112′ also may be injection molded by means of a single mold (not shown) from a suitable polymer, such as an acetal resin, which is preferred, as mentioned above.

The first member 112 has a belt-attaching end 114 including a pair of slots 116, through which a first end of the belt may be passed before being riveted or stitched to other portions of the belt so as to form a closed loop in the belt. The second member 112' has a belt-attaching end including a pair of slots 116', through which a second end of the belt may be passed before being riveted or stitched to other portions of the belt so as to form a closed loop in the belt.

The first member 112 includes a cylindrical receptacle 118, which opens at its inner end 120 into a locking aperture 122. The outer end of the receptacle 118 is flared so as to form a camming surface 124 for a purpose to be hereinafter described. The second member 112' includes a cylindrical receptacle 118', which opens at its outer end 120' into a locking aperture 122'. The outer end of the receptacle 118 is flared so as to form a camming surface 124 for a like purpose.

The first member 112 includes a cantilevered arm 128, which is provided on its distal end with a locking tab 130 having a convex wedging surface 132, and which is provided near its other end with a camming surface 134 for a purpose to be hereinafter described. The second member 112' includes a cantilevered arm 128', which is provided on its distal end with a locking tab 130' having a convex wedging surface 132', and which is provided near its other end with a camming surface 134' for a like purpose.

The cantilevered arm 128 is adapted to be pressed into the receptacle 118' of the second member 112' when the first member 112 and the second member 112' are juxtaposed, presented to each other, and pressed together. The cantilevered arm 128, which is resiliently flexible, has an unflexed position (see FIG. 7) in relation to other parts of the first member 112 and tends to return to the same position when not flexed. The convex wedging surface 132 of the locking tab 130 wedges against the camming surface 124', if and as necessary to facilitate pressing of the cantilevered arm 128 into the receptacle 118'. The locking tab 130 is adapted to be removably received by the locking aperture 122' when the cantilevered arm 128 is pressed fully into the receptacle 118'. The camming surface 134 is structurally and dimensionally adapted to wedge against the camming surface 124' when the cantilevered arm 128 is pressed partially into the receptacle 118' of the second member 112' (see FIG. 8) and to be received by the receptacle 118' when the cantilevered arm 128 is pressed fully into the receptacle 118' of the second member 112' (see FIG. 9).

The cantilevered arm 128' is adapted to be pressed into the receptacle 118 of the first member 112 when the first member 112 and the second member 112' are juxtaposed, presented to each other, and pressed together. The cantilevered arm 128', which is resiliently flexible, has an unflexed position (see FIG. 7) in relation to other parts of the second member 112' and tends to return to the unflexed position when not flexed. The convex wedging surface 132' of the locking tab 130' wedges against the camming surface 124, if and as necessary to facilitate pressing of the cantilevered arm 128' into the receptacle 118. The locking tab 130' is adapted to be removably received by the locking aperture 122 when the cantilevered arm 128' is pressed fully into the receptacle 118. The camming surface 134' is structurally and dimensionally adapted to wedge against the camming surface 124 when the cantilevered arm 128' is pressed partially into the receptacle 118 of the first member 112 (see FIG. 8) and to be received by the receptacle 118 when the cantilevered arm 128' is pressed fully into the receptacle 118 of the first member 112 (see FIG. 9).

As the camming surfaces 124, 124', wedge against the camming surfaces 134', 134, the members 112, 112', are drawn from respective positions (see FIG. 7) wherein the members 112, 112', are not aligned with each other into respective positions (see FIG. 9) wherein the members 112, 112', are aligned with each other.

As presented to each other (see FIGS. 6 and 7) the members 112, 112', are vertically offset in relation to each other. When fully engaged (see FIG. 9) the 112, 112', are in alignment with each other.

When the locking tab 130 is received by the locking aperture 122', a hooked edge 138 of the locking tab 130 is hooked over a complementarily shaped edge 140' of the locking aperture 122'. When the locking tab 130' is received by the locking aperture 122, a hooked edge 138' of the locking tab 130' is hooked over a complementarily shaped edge 140 of the locking aperture 122.

The first member 112 is provided with an actuating member 142, which is cantilevered near the outer end of the receptacle 118 so as to extend back and over the locking receptacle 120, as shown, and which is resiliently flexible. The actuating member 142 has a tab-engaging portion 144, which extends into the locking receptacle 120, and which is adapted to cam against the convex camming surface 132' of the locking tab 130' (when the first member 112 and the second member 112' are fully engaged) if the actuating member 142 flexed so as to press the tab-engaging portion 144 against the locking tab 130'. The actuating member 142 is ribbed along its outer surface 146.

The second member 112' is provided with an actuating member 142', which is cantilevered near the outer end of the receptacle 118' so as to extend each back and over the locking receptacle 120', as shown, and which is resiliently flexible. The actuating member 142' has a tab-engaging portion 144', which extends into the receptacle 120', and which is adapted to cam against the convex camming surface 132 of the locking tab 130 (when the first member 112 and the second member 112' are fully engaged) if the actuating member 142' is flexed so as to press the tab-engaging porting 144' against the locking tab 130. The actuating member 142' is ribbed along its outer surface 146'.

If a user presses on the ribbed surface 146, 146', of the actuating members 142, 142', as by means of a thumb and a forefinger of one hand, the tab-engaging portion 144, 144', of the actuating members 142, 142', cam against the convex camming surfaces 132, 132', of the locking tabs 130, 130', so as to remove the locking tabs 130, 130', from the locking apertures 122, 122'. The locking apertures are horizontally offset in relation to each other, such that manual pressure imparted via the tab-engaging portions 144, 144', on the locking tabs 130, 130', tends also to displace the first member 112 and the second member 112' in relation to each other from their respective positions in FIG. 7 to their respective positions in FIG. 8, generally along the camming surfaces 124, 134', and generally along the camming surfaces 124', 134, such that the first member 112 and the second member 112' tend to spring apart under such pressure.

The buckle 10 and the buckle 110 have a number of common features. Notably, each buckle comprises a pair of members, which are vertically offset when presented to each other, and which when fully engaged are in alignment with each other. Moreover, each member has a wedging or camming surface, which at positions between presentation and full engagement bears against the other member so as to positively drive the members from offset positions into aligned positions. Furthermore, each member has a cantilevered arm or spring finger defining a hook for latching engagement with the other member and being operable via manual pressure to release the book from such engagement and to cause the wedging surface of such member to bear against the other member so as to drive the members from aligned positions into offset positions.

Herein, directional terms such as "vertically" refer to the buckle 10 and the buckle 110, as shown in the drawings. Such terms are not intended to limit the buckle 10, the buckle 110, or any other buckle embodying this invention to any particular orientation.

It is intended by the following claims to cover other modifications and variations within the scope and spirit of this invention.

I claim:

1. A buckle comprising first and second members, which are identical to each other, and which are releasably interlocked to each other;

each member including a receptacle, which has an outer wall; each member having a camming surface; each member having a locking aperture communicating with the receptacle of such member;

each member including a cantilevered arm, which is adapted to be pressed into the receptacle of the other member when the first and second members are juxtaposed and pressed together; the cantilevered arm of each member being resiliently flexible; the cantilevered arm of each member having an unflexed position and tending to return to the unflexed position when not flexed; the cantilevered arm of each member being provided with a locking tab, which is adapted to be removably received by the locking aperture of the other member, so as to releasably lock the first and second members to each other, when arms of each member are pressed fully into the receptacle of the other member; the camming surface of each member being adapted to wedge against the other member, so as to draw the members from respective positions wherein the members are not aligned with each other into respective positions wherein the members are aligned with each other, as the arm of each member is pressed into the receptacle of the other member;

the locking apertures being arranged to permit a user to apply manual pressure on the locking tabs so as to remove the locking tabs from the locking apertures, and so as to displace the first and second members in relation to each other, generally along the camming surfaces of the respective members, such that the first and second members tend to spring apart when such pressure is applied.

2. The buckle of claim 1 wharein the locking tab of each member has a convex wedging surface.

3. The buckle of claim 1 wherein the camming surfaces of the members are ramps inclined in relation to each other so as to form an internal wedge.

4. A buckle comprising a pair of members which are vertically offset when presented to each other, and which when fully engaged are in alignment with each other; each member having a wedging surface, which at positions between presentation and full engagement bears against the other member so as to positively drive the members from vertically offset positions into aligned positions; each member having a spring finger defining a hook for latching engagement with the other member and being operable via manual pressure to release the hook from such engagement and to cause the wedging surface of such member to bear against the other member to drive the members from aligned positions into vertically offset positions.

5. The buckle of claim 4, and wherein the members are identical and each defines a belt loop to which a belt member may be secured.

* * * * *